US008341776B2

(12) United States Patent
Galati, Jr. et al.

(10) Patent No.: US 8,341,776 B2
(45) Date of Patent: Jan. 1, 2013

(54) ADJUSTABLE LEG REST ASSEMBLY

(75) Inventors: Joseph J. Galati, Jr., Brookfield, WI (US); John Meyerovich, Bal Harbour, FL (US)

(73) Assignee: Continuum Footspas, LLC, New Berlin, WI (US)

( * ) Notice: Subject to any disclaimer, the term of this patent is extended or adjusted under 35 U.S.C. 154(b) by 616 days.

(21) Appl. No.: 12/460,207

(22) Filed: Jul. 15, 2009

(65) Prior Publication Data

US 2011/0010843 A1 Jan. 20, 2011

(51) Int. Cl.
*A47K 3/022* (2006.01)

(52) U.S. Cl. ..... 4/622; 297/423.38

(58) Field of Classification Search . 4/622; 297/423.38, 297/423.3

See application file for complete search history.

(56) References Cited

U.S. PATENT DOCUMENTS

| | | | | |
|---|---|---|---|---|
| 335,838 | A | | 2/1886 | Perkins |
| D166,402 | S | | 4/1952 | Manne et al. |
| 2,709,435 | A | | 5/1955 | Kress |
| 3,696,826 | A | | 10/1972 | Gruzalski |
| D227,952 | S | | 7/1973 | Costabile et al. |
| 3,881,471 | A | | 5/1975 | Grube |
| 4,238,097 | A | * | 12/1980 | Clausen et al. ..... 248/188.7 |
| 4,485,503 | A | | 12/1984 | Rolando et al. |
| 4,497,313 | A | | 2/1985 | Kurosawa |
| D282,609 | S | | 2/1986 | Stulik |
| 4,620,529 | A | | 11/1986 | Kurosawa |
| D288,993 | S | | 3/1987 | Grimsrud |
| 4,994,648 | A | | 2/1991 | Gil |
| 5,044,357 | A | | 9/1991 | Johns |
| D346,043 | S | | 4/1994 | Galati, Jr. et al. |
| 5,479,666 | A | | 1/1996 | Foster et al. |
| D391,408 | S | | 3/1998 | Lee |
| 5,729,841 | A | | 3/1998 | Chan |
| D424,819 | S | | 5/2000 | Galati, Jr. et al. |
| D434,916 | S | | 12/2000 | Galati, Jr. et al. |
| D435,371 | S | | 12/2000 | Galati, Jr. et al. |
| 6,230,345 | B1 | | 5/2001 | Borrero et al. |
| 6,309,366 | B1 | | 10/2001 | Maxwell |
| D454,705 | S | | 3/2002 | Long et al. |
| 6,405,390 | B2 | | 6/2002 | Kuen |
| 6,438,768 | B1 | | 8/2002 | Yen |
| 6,503,212 | B2 | | 1/2003 | Park |
| 6,505,358 | B2 | | 1/2003 | Ferber et al. |
| 6,698,038 | B2 | | 3/2004 | Bastia et al. |
| 6,698,039 | B1 | | 3/2004 | Park |
| 6,732,387 | B1 | | 5/2004 | Waldron |
| 6,739,003 | B1 | | 5/2004 | Fanuzzi |
| D498,599 | S | | 11/2004 | Luong |
| 6,880,182 | B2 | | 4/2005 | Gruenwald |

(Continued)

OTHER PUBLICATIONS

AmeriSpa web pages, printed in 2007, 6 pages (http://www.amerispa.com/main.html).

(Continued)

*Primary Examiner* — Gregory Huson
*Assistant Examiner* — Karen L Younkins
(74) *Attorney, Agent, or Firm* — Ryan Kromholz & Manion, S.C.

(57) ABSTRACT

A spa apparatus including a frame, a basin received in the frame, and an adjustable leg rest coupled to the frame. The adjustable leg rest is configured to slide between a first retracted position and a second extended position. The adjustable leg rest is selectively lockingly engaged by a fixation member to hold the adjustable leg rest in the desired position relative to the frame.

21 Claims, 7 Drawing Sheets

U.S. PATENT DOCUMENTS

| | | | |
|---|---|---|---|
| D508,616 | S | 8/2005 | Ziliani |
| D509,371 | S | 9/2005 | Natuzzi |
| D526,505 | S | 8/2006 | Gruenwald et al. |
| 7,089,608 | B2 | 8/2006 | Erb |
| 7,100,220 | B2 | 9/2006 | Lev et al. |
| D531,420 | S | 11/2006 | Kita |
| 7,168,107 | B2 | 1/2007 | Gruenwald |
| D541,060 | S | 4/2007 | Fugate et al. |
| D548,987 | S | 8/2007 | McNae |
| D559,570 | S | 1/2008 | Higgs et al. |
| D568,485 | S | 5/2008 | Ton |
| D574,502 | S | 8/2008 | Ton |
| 7,490,374 | B2 | 2/2009 | Fugate et al. |
| 7,597,390 | B2 | 10/2009 | Galati et al. |
| D623,448 | S | 9/2010 | Galati et al. |
| 2004/0117905 | A1 | 6/2004 | Gruenwald |
| 2004/0177438 | A1 | 9/2004 | Gruenwald et al. |
| 2004/0244107 | A1 | 12/2004 | Waldron |
| 2004/0261173 | A1 | 12/2004 | Chen |
| 2005/0183198 | A1 | 8/2005 | Gruenwald |
| 2005/0204466 | A1 | 9/2005 | Luong |
| 2005/0204467 | A1 | 9/2005 | Bean et al. |
| 2007/0143918 | A1 | 6/2007 | Cafaro et al. |
| 2007/0226897 | A1 | 10/2007 | Fugate |
| 2008/0034494 | A1 | 2/2008 | Monteiro |

OTHER PUBLICATIONS

Belvedere Company web pages, printed in 2007, 7 pages (http://www.belvedere.com/home.aspx).
European Touch web pages, printed in 2007, 8 pages (http://europeantouch.com).
Gulstream Plastics Ltd. web pages, printed in 2007, 7 pages (http://www.gulfstreamplastic.com).
J&A USA web pages, printed in 2007, 10 pages (http://www.jausainc.com).
Lexor Footspas Inc. web pages, printed in 2007, 3 pages (http://www.lexorinc.com).
Salon Equipment, Inc. web pages, printed in 2007, 4 pages (http://www.oasis-se.com/spas/).
ProSpa Inc., web pages, printed in 2007, 2 pages (http://www.prospa1.com/).
Salon Tech, web pages, printed in 2007, 2 pages (http://www.salontech.com/st2007/).
Skyline Beauty Supply Corp.—Whale Spa, web pages, printed Mar. 20, 2008, 6 pages (http://skylinebeautysupply.com).
VNF International, web pages, printed Mar. 20, 2008, 6 pages (http://www.pssnell-service.com/Manufacturer.htm).
T4 Spa Concepts & Design, web pages, printed Mar. 20, 2008, 7 pages (http://www.t4spa.com).
Spa Zi, Division of LC Corp., web pages, printed Mar. 20, 2008, 4 pages (http://www.thespazi.com).
Sanijet—Pipeless Pedicure Equipment, web pages, printed Mar. 20, 2008, 2 pages (http://www.sanijet.com/Products Pedicure.aspx).
Aqua Spas, web pages, printed Mar. 20, 2008, 3 pages (http://aquaspa1.com).
Beauty Mall Ltd., web pages, printed Mar. 20, 2008, 6 pages (http://beautymallltd.com).
Euro Spa, web page, printed Mar. 20, 2008, 1 page (http://www.princesspedicurespas.com/manufacturer/eurospa.html#bella320).
Solojet, web page, printed in 2007, 1 page (http://solojet.com).
Hydro Systems—The Solo, web page, printed in 2007, 2 pages (back to back) (http://www.hydrosystem.com/hydro4/designer/solo/).
SO Sound Solutions, web page, printed in 2007, 1 page (http://www.sosounsolutions.com/).

* cited by examiner

ADJUSTABLE LEG REST ASSEMBLY

BACKGROUND OF THE INVENTION

It is known to provide spa devices such as health spas, whirlpools, and foot spas. In particular, it is known that the treatment of a person's foot may provide therapeutic relief to various points throughout the body. Such spa devices are generally used in commercial and recreational setting for hydrotherapy, massage, stimulation, pedicure and bathing purposes.

Such spa devices may be used for spa treatments of both therapeutic and aesthetic varieties.

Many spa devices currently on the market do not include means for supporting a customer's foot and/or legs. Therefore, the customer must rest their foot on the edge of the basin of the spa device while the technician is providing a therapeutic or aesthetic procedure. This can be inconvenient for the spa technician and uncomfortable for the customer. It is therefore desirable to provide a spa device including means for supporting a customer's foot and or legs during a spa treatment.

SUMMARY OF THE INVENTION

The present invention provides a spa apparatus having a frame, a basin received in or coupled to the frame, an adjustable leg rest slidably coupled to the frame, and fixation member engagably engaged with at least a portion of the frame. The frame has at least one collar coupled to the frame and at least one collar engaging member coupled to the frame. The collar engaging member has an aperture therethrough and the at least one collar extends at least partially though the collar engaging member aperture. The adjustable leg rest includes an elongate member coupled to a leg support. The elongate member has a longitudinal groove extending along at least a portion of the outer surface of the elongate member. The elongate member extends through and is slidably engaged with the at least one collar. The fixation member is engagable between a first position wherein the fixation member does not engage the elongate member and a second position wherein a free end of the fixation member engages the groove of the elongate support member.

The frame may include a vertical portion having a first end and a second end with a first horizontal portion coupled to the first end of the vertical portion and a second horizontal portion coupled to the second end of the vertical portion.

The at least one collar of the apparatus may extend through an aperture in the first horizontal portion of the frame.

The collar engaging member of the apparatus may be coupled to the vertical portion of the frame.

The collar engaging member of the apparatus may have a first portion and a perpendicularly disposed second portion. The at least one collar may extend through an aperture formed in the first portion of the collar engaging member.

The fixation member of the apparatus may include a handle coupled to a threaded rod.

The adjustable leg rest of the apparatus may be positionable between a first retracted position and a second extended position.

The leg support of the apparatus may have a top surface wherein at least a portion of the top surface is concave.

The apparatus may include at least one cover section coupled to the frame.

The apparatus may include at least one wheel coupled to the frame.

The apparatus may include at least one stationary leg rest coupled to the frame.

The present invention provides a method including providing an apparatus with an adjustable leg rest and adjusting the height of the adjustable leg rest. The apparatus includes a frame with at least one collar coupled to the frame and at least one collar engaging member coupled to the frame. The collar engaging member has an aperture therethrough and the at least one collar extends at least partially though the collar engaging member aperture. A basin is coupled to the frame. An adjustable leg rest is slidably coupled to the frame. The adjustable leg rest has an elongate member coupled to a leg support. The elongate member has a longitudinal groove extending along at least a portion of the outer surface of the elongate member. The elongate member extends through and is slidably engaged with the at least one collar. The apparatus includes a fixation member which is rotatably engaged with at least a portion of the frame. The fixation member is rotatable between a first position wherein the fixation member does not engage the elongate member and a second position wherein a free end of the fixation member engages the groove of the elongate support member.

The adjusting step of the method may include rotating the fixation member in a first direction to release the adjustable leg rest, sliding the adjustable leg rest to the desired position and rotating the fixation member in a second direction to secure the adjustable leg rest.

Another aspect of the invention provides an apparatus including a frame having at least one generally hollow cylindrical rod retaining portion, a basin received in the frame, an adjustable leg rest slidably coupled to the frame, and a fixation member coupled to the rod retaining portion and engagably engaged with at least a portion of the adjustable leg rest. The adjustable leg includes a elongate member coupled to a leg support. The elongate member extends through and is slidably engaged with the at least one rod retaining portion. The fixation member is engagable between a first position wherein the fixation member does not engage the elongate member and a second position wherein the fixation member engages the outer surface of the elongate support member.

The frame of the apparatus may include a vertical portion having a first end and a second end, a first horizontal portion coupled to the first end of the vertical portion, and a second horizontal portion coupled to the second end of the vertical portion.

The rod retaining portion of the apparatus may include a sleeve coupled to the frame between the first horizontal portion and the second horizontal portion wherein at least a portion of the sleeve extends outwardly from the first horizontal portion of the frame.

The fixation member of the apparatus may include a clamp having an upper circumferential clamp portion coupled to a lower circumferential clamp portion, the upper circumferential clamp portion having an adjustment member.

The apparatus may include the lower circumferential clamp portion engaging the outer surface of the sleeve and the upper circumferential clamp portion being engagable between a first position wherein the upper circumferential clamp portion does not engage the elongate member and a second position wherein the upper circumferential clamp portion engages the outer surface of the elongate support member.

The adjustable leg rest of the apparatus may be positionable between a first retracted position and a second extended position.

The leg support of the apparatus may have a top surface wherein at least a portion of the top surface is concave.

The apparatus may include t least one cover section coupled to the frame.

The apparatus may include at least one wheel coupled to the frame.

The apparatus may include at least one stationary leg rest coupled to the frame.

Another aspect of the invention provides a method including providing an apparatus and adjusting the height of the adjustable leg. The frame includes at least one rod retaining portion which has a generally hollow cylindrical configuration. A basin is received in the frame. An adjustable leg rest is slidably coupled to the frame. The adjustable leg rest has an elongate member coupled to a leg support. The elongate member extends through and is slidably engaged with the at least one rod retaining portion. The apparatus includes a fixation member coupled to the rod retaining portion. The fixation member is a clamp having an upper circumferential clamp portion coupled to a lower circumferential clamp portion. The upper circumferential clamp portion has an adjustment member. The lower circumferential clamp portion engages the outer surface of the sleeve and the upper circumferential clamp portion is engagable between a first position wherein the upper circumferential clamp portion does not engage the elongate member and a second position wherein the upper circumferential clamp portion engages the outer surface of the elongate support member.

The adjusting step of the method may include rotating the adjustment member in a first direction to release the adjustable leg rest, sliding the adjustable leg rest to the desired position, and rotating the adjustment member in a second direction to secure the adjustable leg rest.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
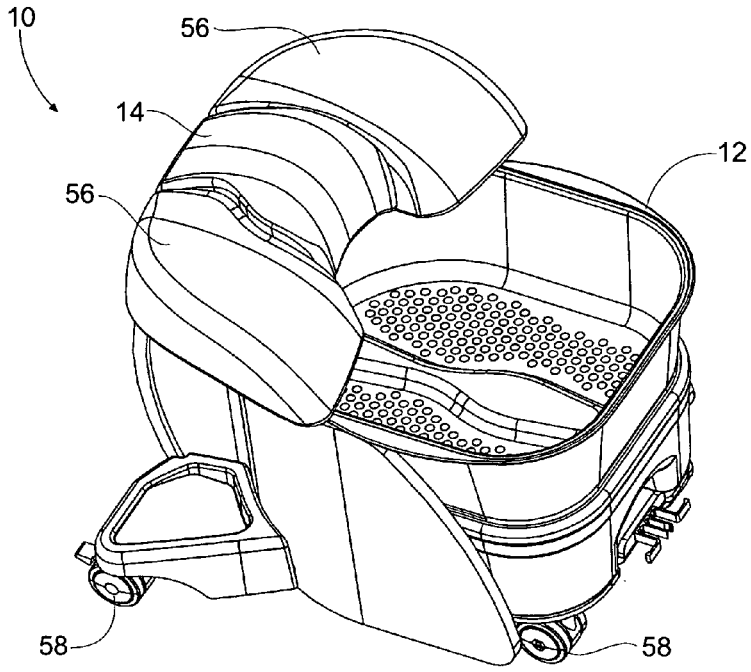
FIG. 1 is a front perspective view of a foot spa apparatus with adjustable foot rest according to the present invention, with the adjustable foot rest in the down position.
Figure 2:
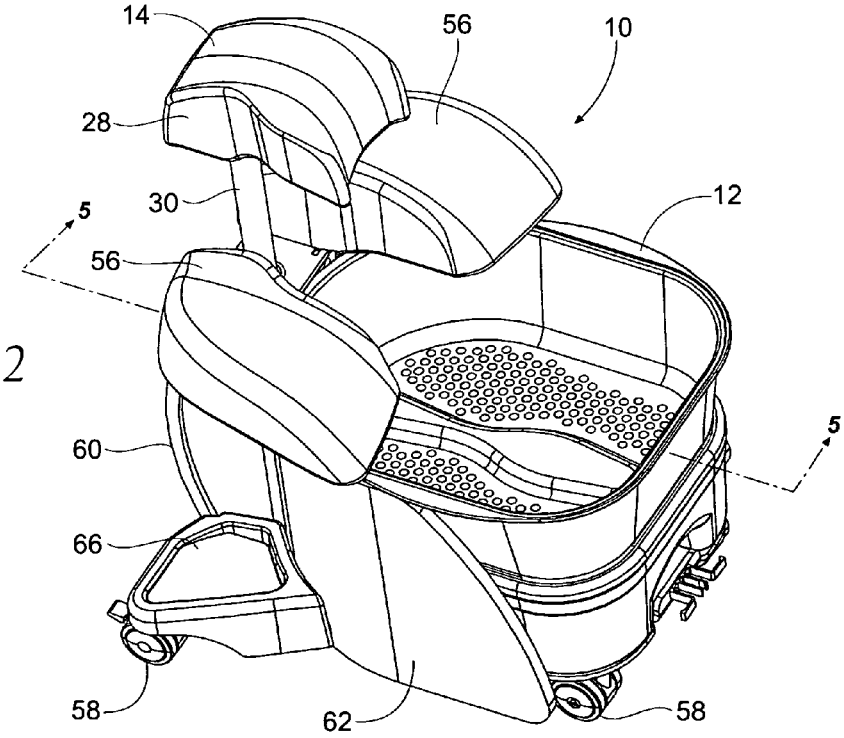
FIG. 2 the apparatus of FIG. 1 with the adjustable foot rest in the up position.

As shown in FIG. 1 the apparatus 10 of the present invention preferably includes a basin 12 and at least one adjustable leg rest 14. The basin 12 is received within the frame 16 and preferably coupled thereto. The at least one adjustable leg rest 14 is also preferably coupled to a frame 16. As will be described in more detail below, the adjustable leg rest 14 is positionable at various positions between a first retracted position (FIG. 1) and a second extended position (FIG. 2).

Figure 4:
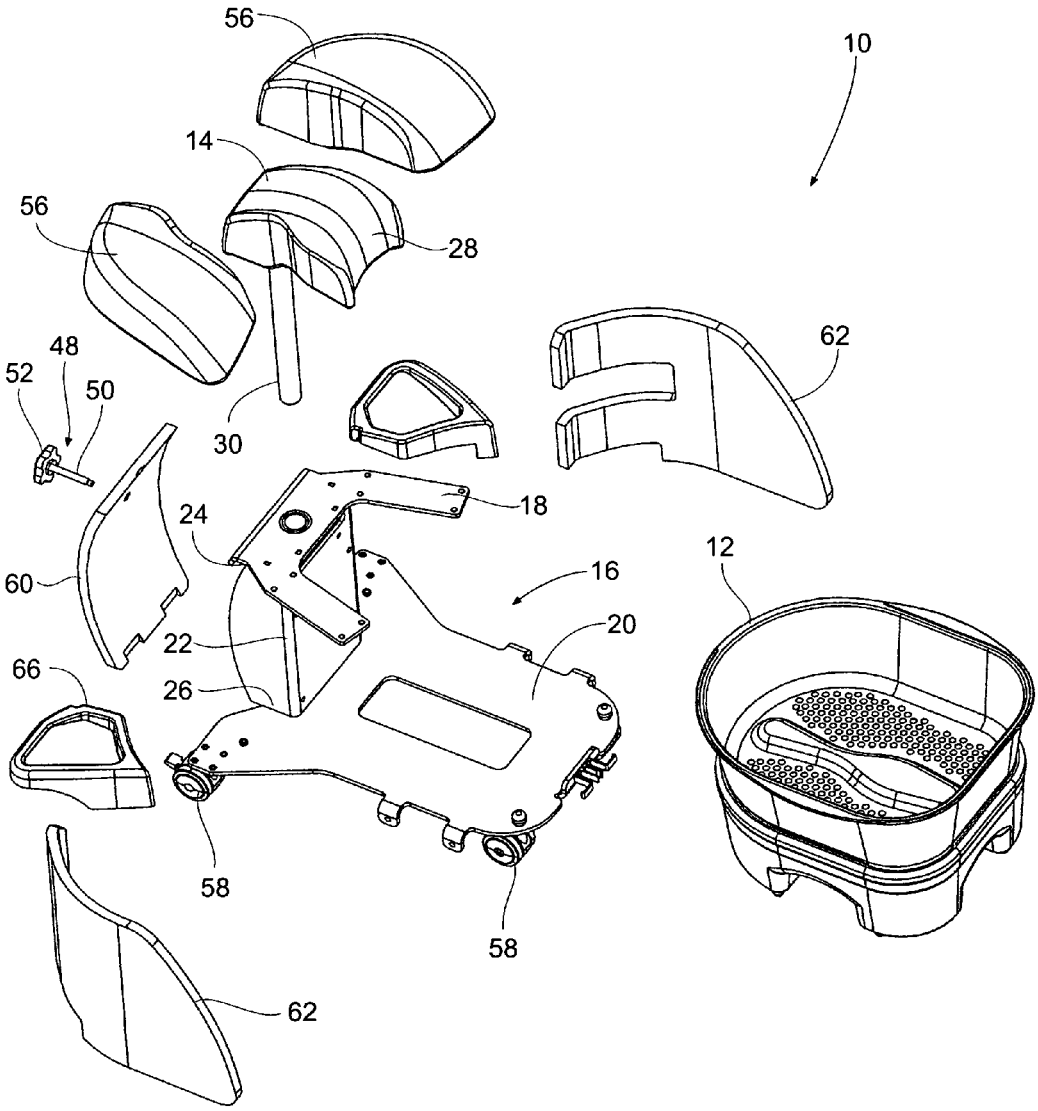
FIG. 4 is a partially exploded view of the apparatus of FIG. 1.

As shown in FIG. 4, the frame 16 preferably includes a first horizontal portion 18, a second horizontal portion 20, and a vertical portion 22. The vertical portion 22 preferably has a first end 24 and a second end 26. The first horizontal portion 18 is preferably coupled to the first end 24 of the vertical portion 22. The second horizontal portion 20 is preferably coupled to the second end 26 of the vertical portion 22.

The basin 12 is preferably coupled to the second horizontal portion 20 of the frame 16. The basin 12 may take any form known in the art.

The adjustable leg rest 14 preferably includes an elongate member 30 coupled to the bottom surface of a leg support 28. In the illustrated embodiment the top surface of the leg support 28 is has a generally concave configuration to receive the leg of a user, however it is contemplated that the leg support 28 may take any form known in the art. The elongate member 30 preferably includes a longitudinal groove 54 formed on the surface thereof.

Figure 5:
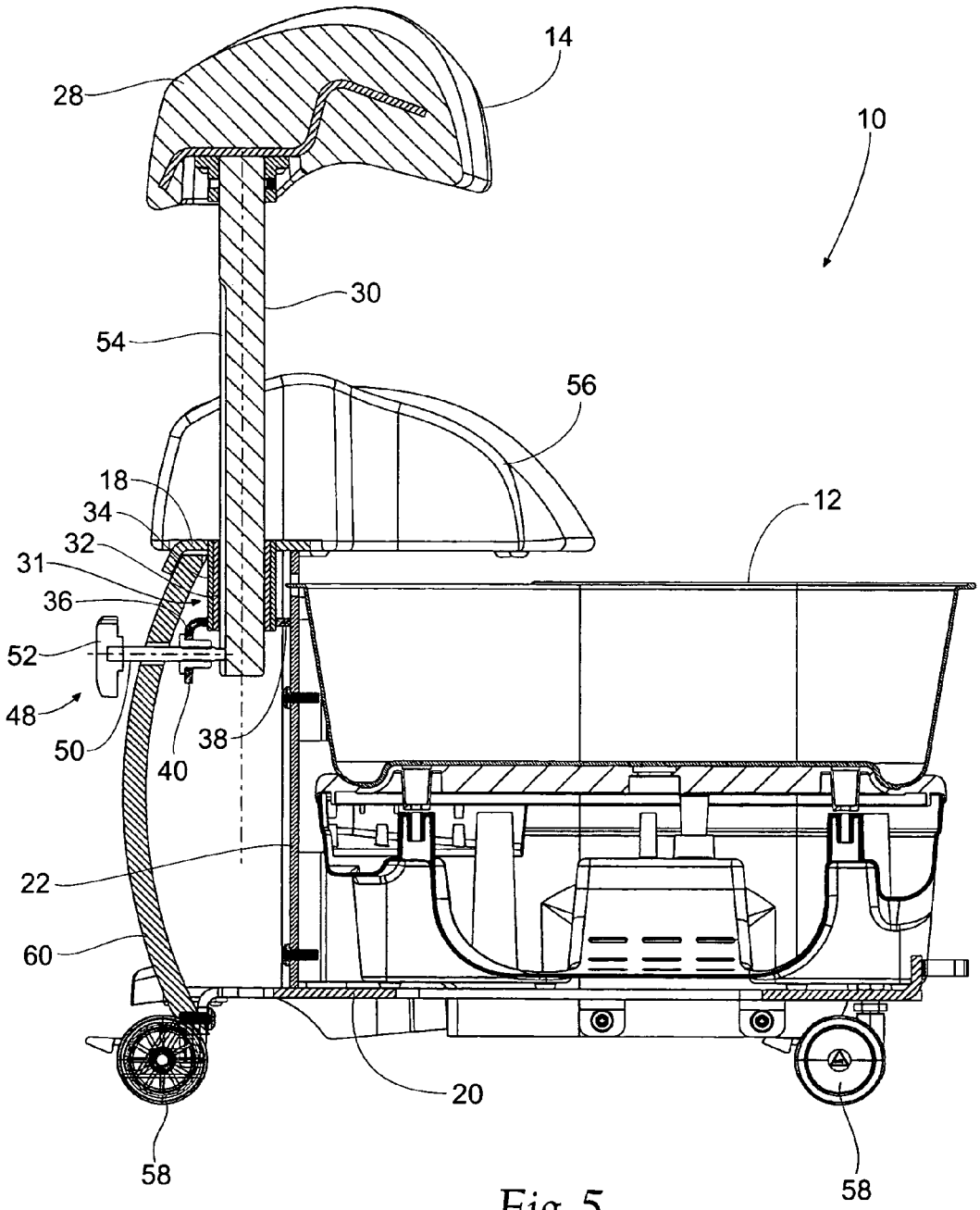
FIG. 5 is a partial cross sectional view of the apparatus of FIG. 1.

The adjustable leg 14 is preferably coupled to the frame 16 as shown in FIG. 5. The frame 16 preferably includes a rod retaining portion 31. In this illustrated embodiment, the rod retaining portion 31 takes the form of an inner collar 32 and an outer collar 34 which extend through an aperture in the first horizontal portion 18 of the frame 16. The inner collar 32 and outer collar 34 are concentrically arranged. A collar engaging member 36 is coupled to the vertical frame member 22. The collar engaging member 36 preferably has a first portion 38 and a generally perpendicularly disposed second portion 40. The first portion 38 and second portion 40 may be integrally formed or may be separately formed and coupled using any means known in the art. The free end of the first portion 38 of the collar engaging member 36 is preferably coupled to the vertical frame member 22 near the first end 24 thereof. The first portion 38 of the collar engaging member 36 preferably has an aperture 42 therethrough sized and configured to receive the inner collar 32 and outer collar 34.

The second portion 40 of the collar engaging member 36 preferable has an aperture 44 therethrough. An internally threaded bushing 46 is preferably disposed with the aperture 44. A threaded fixation member 48 is preferably threaded through the bushing. In the illustrated embodiment the fixation member 48 takes the form of a threaded rod 50 coupled to a handle 52.

In use, the elongate member 30 of the adjustable leg rest 14 is placed through the inner collar 32. The adjustable leg rest 14 may be slid up and/or down to reach the desired height. When the desired height is reached, the fixation member 48 is rotated in a first direction until the free end of the threaded rod 50 engages the groove 54 in the elongate member 30 of the adjustable leg rest 14. The fixation member 48 is preferably rotated until the elongate member 30 is held firmly in position with respect to the inner collar 32 and fixation member 48. To adjust the height of the leg rest 14, the fixation member 48 is rotated in a second direction to release the leg rest 14. The height of the adjustable leg rest 14 may then be adjusted as described above to the desired height. The fixation member 48 is then again rotated in a first direction to secure the leg rest 14 by engagement of the elongate portion 30 with the fixation member 48 and inner collar 32.

Figure 3:
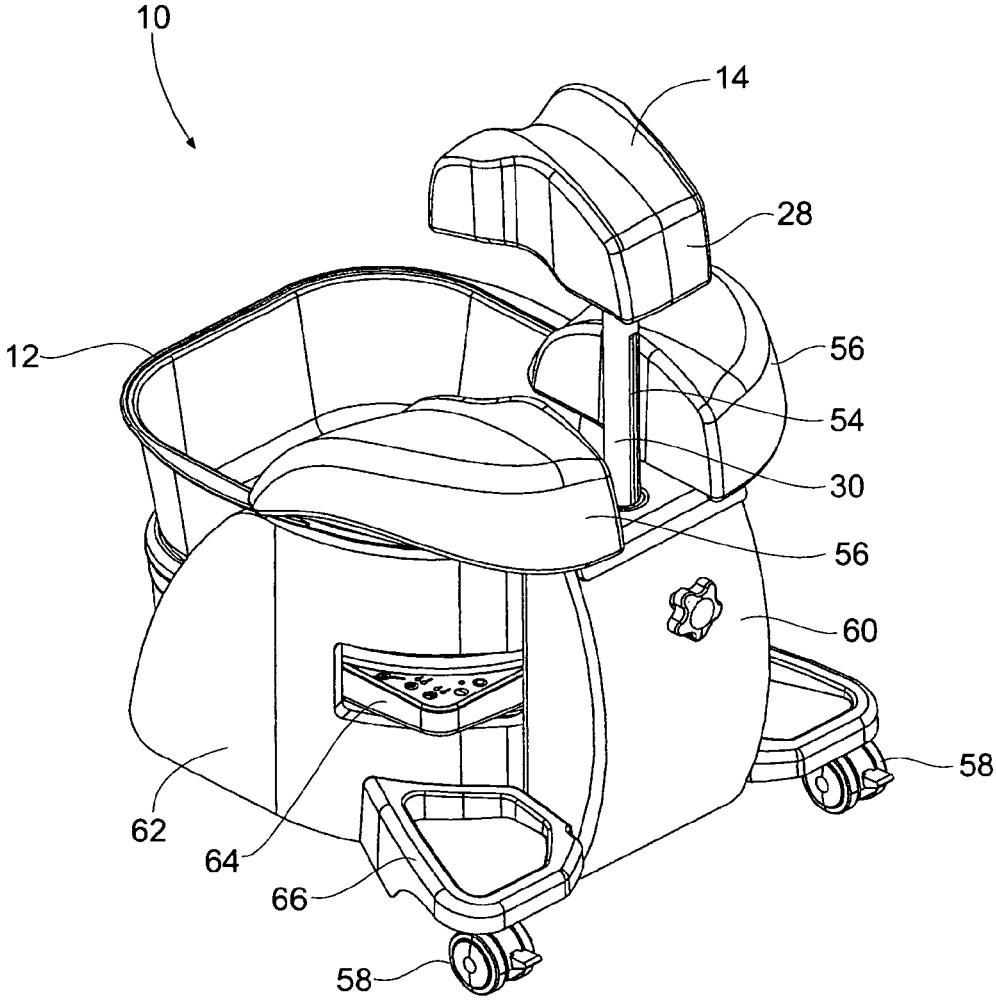
FIG. 3 is a rear perspective view of the apparatus of FIG. 1.

The apparatus 10 may include at least one cover portion to at least partially cover the frame 16 and provide an aesthetically pleasing appearance. As shown in FIG. 4, the illustrated embodiment the apparatus includes a back cover 60 and a pair of side covers 62. The back cover 60 preferably includes an aperture therethrough through which the fixation member 48 extends. As shown in FIG. 3, at least one of the side covers 62 may include at least one aperture therethrough for the electronic controls 64 or other elements of the apparatus 10 to extend through.

The apparatus 10 of the illustrated embodiment includes a center adjustable leg rest 14 and stationary left and right leg rests 56. However, it is contemplated that an apparatus according to the invention could have a single adjustable leg rest 14.

It is further contemplated that the apparatus 10 of the present invention may include at least one wheel 58. The at least one wheel 58 is preferably coupled to the bottom surface of the frame 16. In the illustrated embodiment four wheels 58 are utilized, however it is contemplated that fewer or more wheels 58 may be provided based on the specific configuration of the frame 16. The wheels 58 may take any form known in the art, however preferably at least one wheel 58 includes a stop or lock to prevent the wheel 58 from rotating while the apparatus 10 is in use.

As shown in FIGS. 3 and 4, the apparatus 10 may include one or more trays 66 which may be coupled to apparatus 10. The trays 66 may be utilized for any purpose, including but not limited to, holding or storing various items related to providing services using the foot spa apparatus 10. For example, tools or products used by a technician providing a pedicure may be held or stored on the trays 66.

Although the illustrated embodiment of the adjustable leg rest 14 is shown in use with an apparatus taking the form of a portable foot spa, it is contemplated that the adjustable leg rest 14 may be utilized in other applications, including but not limited to a stationary foot spa.

Figure 6:
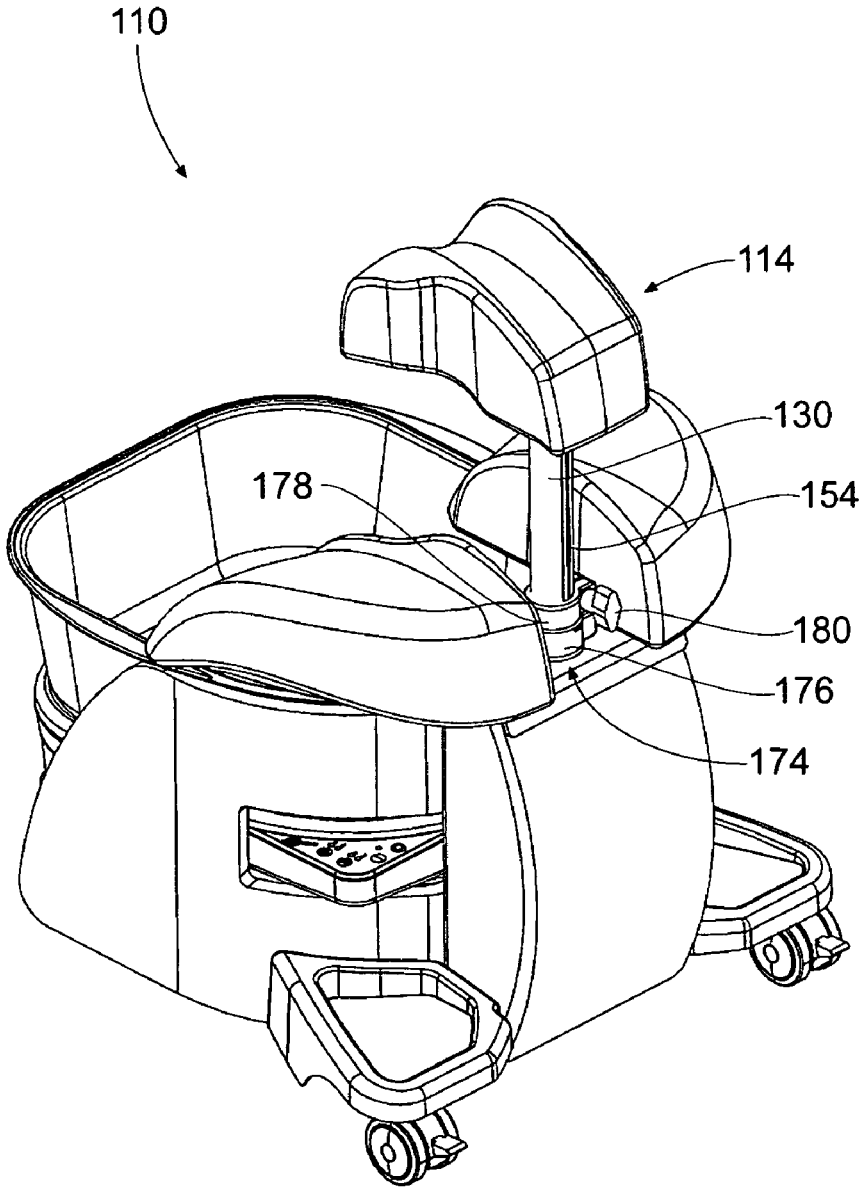
FIG. 6 is a rear perspective view of an alternative embodiment of an apparatus according to the present invention with the adjustable foot rest in the up position.
Figure 7:
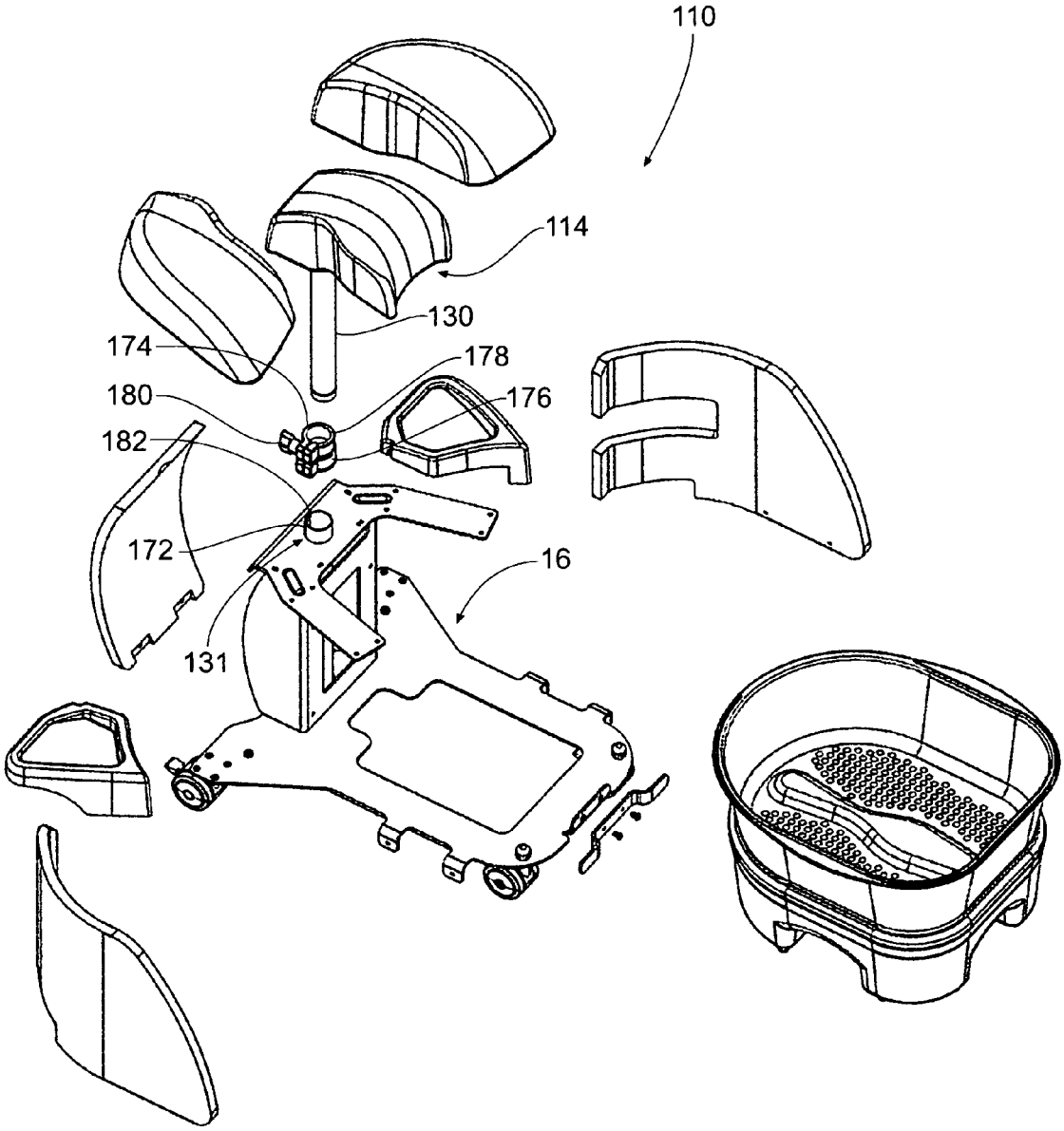
FIG. 7 is a partially exploded view of the apparatus of FIG. 6.
Figure 8:
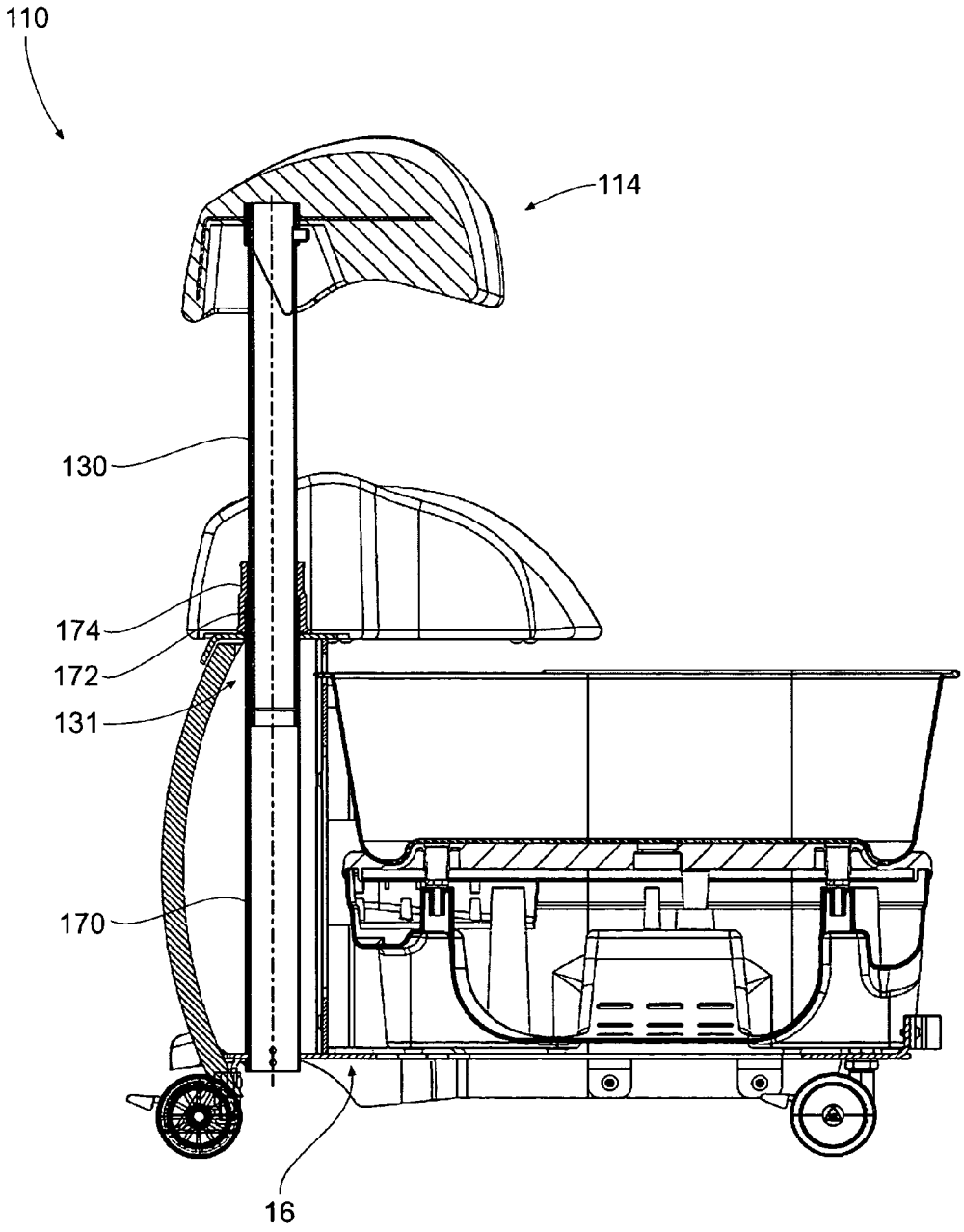
FIG. 8 is a partial cross sectional view of the apparatus of FIG. 6.

FIGS. 6 through 8 show an alternative embodiment of an apparatus 110 according to the present invention. The apparatus of FIGS. 6 through 8 is similar to the embodiment of FIGS. 1 through 5, except that the leg is coupled to the frame in an alternative manner. In the embodiment of FIGS. 6 through 8, the fixation member may take the form of a clamp 174.

As shown in FIG. 8, the apparatus 110 includes a rod retaining portion 131 taking the form of a sleeve 170 extending through the frame 16 from the first horizontal portion 18 to the second horizontal portion 20. At least a portion 172 of the sleeve 170 extends outwardly from the first horizontal member 18 of the frame 16. The rod portion 130 of the leg rest is preferably slidable engagable within the sleeve 170. As will be described in more detail below, a fixation member 148 taking the form of a clamp 174 is used adjustable fix the leg rest 114 in position relative to the frame 16.

Preferably, a clamp 174 is placed over the exposed portion 172 of the sleeve 170. The clamp preferably has a lower portion 176 sized and configured to engage the sleeve and a upper portion 178 sized and configured to engage the rod portion 130 of the leg rest 114. Each of the upper 178 and lower portions 176 of the clamp 174 take the form of generally circumferential compression clamps. In use, the rod portion 130 of the leg rest 114 is inserted through the clamp 174 and into the sleeve 170. The upper portion 178 of the clamp 174 preferably includes an adjustment member 180 to selectively tighten or loosen the upper portion 178 of the clamp 174.

It should be understood that the outer diameter of the rod portion 130 is at least slightly smaller than the inner diameter of the sleeve 170 such that the rod portion 130 slides within the sleeve 170. It should further be understood that the inner diameter of the lower portion 176 of the clamp 174 is slightly larger than the inner diameter of the upper portion 178 of the clamp 174, as the outer diameter of the sleeve 170 is greater than the outer diameter of the rod portion 130.

In use, the leg rest 114 is slid to the desired height. The adjustment member 180 of the clamp 174 is then turned in a first direction to tighten the clamp 174 around the rod portion 130 and hold the leg rest 114 in the desired position. The leg rest 114 may be released by turning the adjustment member 180 in a second direction.

Preferably the sleeve 170 includes a protrusion 182 sized and configured to engage a groove 154 formed along the length of the rod portion 130. The engagement of the protrusion 182 with the groove 154 prevents the adjustable leg rest 114 from rotating with respect to the frame 16.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. An apparatus comprising:

a frame, the frame including at least one collar coupled to the frame, and at least one collar engaging member coupled to the frame, the collar engaging member having an aperture therethrough and the at least one collar extending at least partially though the collar engaging member aperture;

a basin received in the frame;

an adjustable leg rest slidably coupled to the frame, the adjustable leg rest having an elongate member coupled to a leg support, the elongate member having a longitudinal groove extending along at least a portion of the outer surface of the elongate member, the elongate member extending through and being slidably engaged with the at least one collar; and a fixation member, the fixation member engagably engaged with at least a portion of the frame, the fixation member being engagable between a first position wherein the fixation member does not engage the elongate member and a second position wherein a free end of the fixation member engages the groove of the elongate support member.

2. The apparatus of claim 1 wherein the frame further comprises a vertical portion having a first end and a second end, a first horizontal portion coupled to the first end of the vertical portion, and a second horizontal portion coupled to the second end of the vertical portion.

3. The apparatus of claim 2 wherein the at least one collar extends through an aperture in the first horizontal portion of the frame.

4. The apparatus of claim 3 wherein the collar engaging member is coupled to the vertical portion of the frame.

5. The apparatus of claim 4 wherein the collar engaging member has a first portion and a perpendicularly disposed second portion and the at least one collar extends through an aperture in the first portion of the collar engaging member.

6. The apparatus of claim 1 wherein the fixation member further comprises a handle coupled to a threaded rod.

7. The apparatus of claim 1 wherein the adjustable leg rest is positionable between a first retracted position and a second extended position.

8. The apparatus of claim 1 wherein the leg support has a top surface and wherein at least a portion of the top surface is concave.

9. The apparatus of claim 1 further comprising at least one cover section coupled to the frame.

10. The apparatus of claim 1 further comprising at least one wheel coupled to the frame.

11. The apparatus of claim 1 further comprising at least one stationary leg rest coupled to the frame.

12. An apparatus comprising:

a frame, the frame including at least one rod retaining portion, the rod retaining portion having a generally hollow cylindrical configuration;

a basin received in the frame;

an adjustable leg rest slidably coupled to the frame, the adjustable leg rest having an elongate member coupled to a leg support, the elongate member extending through and being slidably engaged with the at least one rod retaining portion; and a fixation member, the fixation member coupled to the rod retaining portion and engagably engaged with at least a portion of the adjustable leg rest, the fixation member being engagable between a first position wherein the fixation member does not engage the elongate member and a second position wherein the fixation member engages the outer surface of the elongate support member.

13. The apparatus of claim 12 wherein the frame further comprises a vertical portion having a first end and a second end, a first horizontal portion coupled to the first end of the vertical portion, and a second horizontal portion coupled to the second end of the vertical portion.

14. The apparatus of claim 13 wherein the rod retaining portion further comprises a sleeve coupled to the frame between the first horizontal portion and the second horizontal portion wherein at least a portion of the sleeve extends outwardly from the first horizontal portion of the frame.

15. The apparatus of claim 14 wherein the fixation member further comprises a clamp having an upper circumferential clamp portion coupled to a lower circumferential clamp portion, the upper circumferential clamp portion having an adjustment member.

16. The apparatus of claim 15 wherein the lower circumferential clamp portion engages the outer surface of the sleeve and the upper circumferential clamp portion is engagable between a first position wherein the upper circumferential clamp portion does not engage the elongate member and a second position wherein the upper circumferential clamp portion engages the outer surface of the elongate support member.

17. The apparatus of claim 16 wherein the adjustable leg rest is positionable between a first retracted position and a second extended position.

18. The apparatus of claim 12 wherein the leg support has a top surface and wherein at least a portion of the top surface is concave.

19. The apparatus of claim 12 further comprising at least one cover section coupled to the frame.

20. The apparatus of claim 12 further comprising at least one wheel coupled to the frame.

21. The apparatus of claim 12 further comprising at least one stationary leg rest coupled to the frame.

* * * * *

UNITED STATES PATENT AND TRADEMARK OFFICE

CERTIFICATE OF CORRECTION

PATENT NO. : 8,341,776 B2
APPLICATION NO. : 12/460207
DATED : January 1, 2013
INVENTOR(S) : Galati, Jr. et al.

It is certified that error appears in the above-identified patent and that said Letters Patent is hereby corrected as shown below:

Column 6, line 29, after "at least partially" delete "though" and substitute -- through --.

Signed and Sealed this
Ninth Day of April, 2013

Teresa Stanek Rea
*Acting Director of the United States Patent and Trademark Office*